US007724908B2

(12) United States Patent
Westergaard et al.

(10) Patent No.: US 7,724,908 B2
(45) Date of Patent: May 25, 2010

(54) SYSTEM AND METHOD FOR PROGRAMMING A HEARING AID

(75) Inventors: Anders Westergaard, Herlev (DK); Jakob Palitzsch Lund, Vejby (DK)

(73) Assignee: WIDEX A/S, Lynge (DK)

( * ) Notice: Subject to any disclaimer, the term of this patent is extended or adjusted under 35 U.S.C. 154(b) by 1243 days.

(21) Appl. No.: 11/235,419

(22) Filed: Sep. 27, 2005

(65) Prior Publication Data

US 2006/0029245 A1 Feb. 9, 2006

Related U.S. Application Data

(63) Continuation-in-part of application No. PCT/DK03/00211, filed on Mar. 28, 2003.

(51) Int. Cl.
*H04R 25/00* (2006.01)

(52) U.S. Cl. ..... 381/60; 381/312

(58) Field of Classification Search ..... 381/60
See application file for complete search history.

(56) References Cited

U.S. PATENT DOCUMENTS

| | | | | |
|---|---|---|---|---|
| 4,759,070 | A * | 7/1988 | Voroba et al. | 381/60 |
| 5,687,279 | A * | 11/1997 | Matthews | 704/201 |
| 5,910,997 | A | 6/1999 | Ishige | |
| 6,075,662 | A | 6/2000 | Harrison | |
| 6,115,478 | A * | 9/2000 | Schneider | 381/314 |
| 6,463,405 | B1 * | 10/2002 | Case | 704/206 |
| 6,675,148 | B2 * | 1/2004 | Hardwick | 704/500 |
| 7,006,646 | B1 | 2/2006 | Baechler | |

FOREIGN PATENT DOCUMENTS

| | | | |
|---|---|---|---|
| EP | 1250026 | A1 | 10/2002 |
| FR | 2 651 634 | A1 | 3/1991 |
| WO | 9949715 | A2 | 10/1999 |
| WO | WO 02/11509 | A1 | 2/2002 |
| WO | WO 03/003792 | A1 | 1/2003 |

* cited by examiner

*Primary Examiner*—Brian Ensey
(74) *Attorney, Agent, or Firm*—Sughrue Mion, PLLC

(57) ABSTRACT

A system for providing a talk-over functionality from an attendant to a hearing aid user comprises a hearing aid (4), a link device (5) connected to the hearing aid (4), a computer (7) with a talk-over microphone (9), and a communications link (6) linking the computer (7) to the link device (5), the hearing aid user, the hearing aid (4), and the link device (5) being positioned in a sound-proof box (1). The computer (7) is adapted for receiving signals from the microphone (9), and for executing audio processing software for processing the microphone signals for converting them into compressed, digital audio signals and transmitting these signals via the communications link (6) to the link device (5). The link device (5) is adapted for decompressing the received signals and converting them into audio signals to be served to the hearing aid (4) in real-time. The system enables an attendant or a hearing aid fitter to talk to a hearing aid user via the communications link (6). This may, for instance, be useful when the hearing aid user is acoustically isolated from the fitter during fitting of the hearing aid (4). The invention provides a system and a method for providing a talk-over functionality.

11 Claims, 3 Drawing Sheets

SYSTEM AND METHOD FOR PROGRAMMING A HEARING AID

RELATED APPLICATIONS

The present application is a continuation-in-part of application No. PCT/DK2003/000211, filed on 28 Mar. 2003 in Denmark.

BACKGROUND OF THE INVENTION

1. Field of the Invention

The present invention relates to hearing aids and to methods of fitting hearing aids. This invention more specifically relates to the fitting of hearing aid systems to individual users, in particular to the fitting of systems utilizing some form of digital signal processing in the fitting chain.

2. The Prior Art

Talk-over or talk-back systems are used in a wide variety of applications, for instance in professional recording or broadcasting studios in the music industry, where they enable an auditive communications link from the control room to the studio itself. In these settings, the talk-back function enables the audio engineer or the producer to provide anyone in the studio with information, instructions or requests. The talk-back function is usually activated by a dedicated switch, conveniently placed on the mixing console or elsewhere in the control room, and relies on a talk-back microphone placed in the control room, a dedicated signal pathway and means for reproducing the signal from the talk-back microphone to the person(s) in the studio. To the best knowledge of the inventor it has, however, never been applied to the field of hearing aid fitting, perhaps due to the practical limitations involved.

U.S. Pat. No. 2,255,517 discloses a talk-back communication system permitting a plurality of remote transducer terminals to make replies to voice communication from a central transducer terminal. The talk-back signal path is initiated by activating a push button switch at any one of the remote transducer terminals, thereby temporarily breaking the normal signal path from the central transducer terminal to the remote transducer terminal in question, and restoring the normal signal path again by release of the switch when communication from the remote terminal ceases. This system, however, does not deal with transmission through a narrow-band communication channel, nor does it incorporate any digital signal path.

U.S. Pat. No. 6,360,093 B1 discloses a system for wireless voice broadcasting utilizing a computer network for delivering telephony between a number of wireless terminals via an internet or intranet server in a coded, digital audio format. Any of the wireless terminals may initiate transmission at any time, as the server software controls the signals from the individual transmitters.

WO 01/56331 provides an auditory prosthesis together with a programming device and means for transmitting signals from the hearing aid to the programming device.

EP 0453450 A1 discloses a device for wirelessly communicating programming data from a personal computer to a receiving hearing aid. During programming, the PC, running suitable hearing aid programming software, communicates instructions regarding gain in different frequency bands, compression, etc. to the hearing aid.

DE 19541648 describes a setup with a PC equipped with a transmitter/receiver module in wireless communication with a mobile transmitter module connected to a hearing aid.

Commercial systems for wireless programming of hearing aids via a link device are optimized for high throughput and simple hardware. This is achieved by using a variable bit rate and a relatively large digital packet size in the buffered communication protocol used. In a setup of this kind, the attainable bandwidth is about 250 kbps, which is sufficient for programming but unusable for uncompressed audio with full frequency range, claiming a bandwidth of around 2 Mbps.

Within the field of telecommunications it is known to reduce the bandwidth of an audio signal prior to digital conversion and transmission, for instance to a bandwidth of 64 kbps fixed rate transmission, as used in a standard ISDN telephone connection. However, driving a 64 kbps fixed rate transmission through a link device utilizing a variable bit-rate protocol requires a high rate of data packet transmissions, and thus, the number of data packets required for providing an effectively continuous transmission would be so large that the overhead in buffering and processing the individual data packets in the link device would consume too much time for the link device processor to achieve a continuous transmission without loss of some of the packets due to buffer overflow.

Recent development in digital hearing aids has provided fitters and audiologists with advanced tools for determining hearing loss, for selecting and fitting suitable hearing aids to compensate for the hearing loss, and for fine tuning hearing aids to match the user's hearing loss profile as closely as possible. The digital technology permits the use of dedicated software for performing these tasks by programming appropriate parameter values into the hearing aid processor. The most advanced, programmable hearing aids provide for several programmes to be stored in the memory of a hearing aid for instant recall and use at any one time by the hearing aid user.

Fitting of modem hearing aids to an individual user is typically performed by the audiologist by using the values from an individual audiogram determined at an earlier stage. The audiogram data are processed according to a fitting rule in order to determine suitable settings for optimum compensation of the user's hearing deficiency. The parameter settings are subsequently programmed into a hearing aid.

The fit may be tested and fine tuned in a procedure where the user is placed in a selected acoustic environment and allowed to listen and to test variations in the settings. For testing, simulated acoustic environments are generated in a test chamber, where the user is located. The audiologist will conduct the testing and will remotely adapt the hearing aid settings.

The fitting is an interactive procedure between the audiologist and the user. During the fitting, however, communication from the audiologist to the hearing aid user can be a real problem. A dedicated talk-over system could be used for this purpose, however, this represents an added capital cost and complication.

SUMMARY OF THE INVENTION

In a first aspect, the invention provides a system for providing a talk-over functionality from an attendant to a hearing aid user, comprising a hearing aid, a link device connected to the hearing aid, a computer with a talk-over microphone, and a communications link linking the computer to the link device, the computer having audio processing software for processing audio signals from the talk-over microphone to compress them into compressed, audio signals and for transmitting the compressed audio signals by the communications link to the link device, the link device being adapted for receiving and decompressing the compressed audio signals to convert them into audio signals to be served to the hearing aid.

The benefit of such a system is the fact that a talk-over capability may be provided with no special hardware or external equipment apart from what is generally available in a typical fitting situation. According to the invention a link device, or similar devices generally available in hearing aid fitting clinics, for programming hearing aids, can be put to use for the purpose of transferring the audio data to the hearing aid. Suitable devices adapted for providing a communication channel between the hearing aid and the fitting computer utilize some form of digital, wired or wireless, communication. One example of a wireless communication is the Bluetooth® system.

The system according to the invention provides compressing the digital data packages representing the sound signal into a compressed data format suitable for being transferred as a data stream via a transmission channel of small capacity. This makes it possible to rely on a narrow-band transmission channel means which may not have sufficient capacity to transfer uncompressed audio data. This encompasses, among other technologies, various serial data communication interfaces, the Bluetooth® standard devices and other link devices used in fitting and programming hearing aid devices.

In a second aspect, the invention provides a system for programming a hearing aid, comprising a link device connected to the hearing aid, a computer with a talk-over microphone, and a communications link linking the computer to the link device, the communications link being adapted for transmitting data from the link device to the computer and from the computer to the link device, the computer being programmed for reading data from the hearing aid, for writing into the hearing aid programming parameter settings, for processing audio signals from the talk-over microphone to compress them into compressed, audio signals and for transmitting the compressed audio signals to the link device, the link device being adapted for receiving and decompressing the compressed audio signals to convert them into audio signals to be served to the hearing aid.

The processing of the signals in the link device provides for compression of the signals from the hearing aid prior to transmission to the computer, and processing of the received signals in the computer provides for decompression and conversion of the signals to audio signals after reception, thereby allowing the fitter at the computer to selectively monitor the sound picked up and processed by the hearing aid using the communications link.

In a third aspect, the invention provides a method for providing a talk-over functionality from an attendant to a hearing aid user, comprising the steps of picking up sound signals from the attendant by a microphone, converting the picked-up sound signals into digital data frames, converting the digital data frames into compressed data frames, transmitting the compressed data frames via a communications link, receiving the compressed data packets in a link device, decoding the compressed data packets in said link device, and transmitting the decoded data frames representing the sound signals to a hearing aid for acoustic reproduction.

By compressing the audio signal before transmission via the link device, the necessary data transmission rate through the link device is greatly reduced. This makes it possible to use a digital communication protocol with a relatively modest bandwidth, and even one with a variable bit-rate protocol, to transfer the data packets representing the signal without noticeable degrading impact on the received sound signal. Existing link devices used for the programming and fitting of hearing aids can thus be used to transfer the compressed, digital, talk-over sound signals to the hearing aid.

The algorithms used to compress the digital audio signals before transmission via the link device can be any suitable audio compression algorithm known in the art. Space-efficient, lossy algorithms, such as the MPEG (Motion Picture Experts Group) audio layer 3, also known as MP3, or the ATRAC (Adaptive Transform Acoustic Coding for MiniDisc) are preferred algorithms, as they are able to compress the audio data very substantially, e.g. as much as 10:1-14:1 while providing adequate reproduction quality. This limits the transmission buffer requirements considerably.

Both of these compression schemes are, however, lossy, i.e. they sacrifice parts of the signal during the coding process, preferably parts of the signal that the listener assumably cannot hear, based on psychoacoustic modeling. Other embodiments may use lossless compression schemes, e.g. LZW-compression (Lempel-Ziv-Welch compression, covered by U.S. Pat. No. 4,558,302, in the name of Unisys), or the like. This will usually result in a higher fidelity in the reproduction of the audio signal, but at the price of not being able to compress the audio data as effectively, thus putting a higher strain on the limited-capacity transmission channel. Further advantageous features will appear from the dependent claims.

BRIEF DESCRIPTION OF THE DRAWINGS

The invention will now be described in greater detail with respect to the drawings, where.

DETAILED DESCRIPTION OF THE INVENTION

Figure 1:
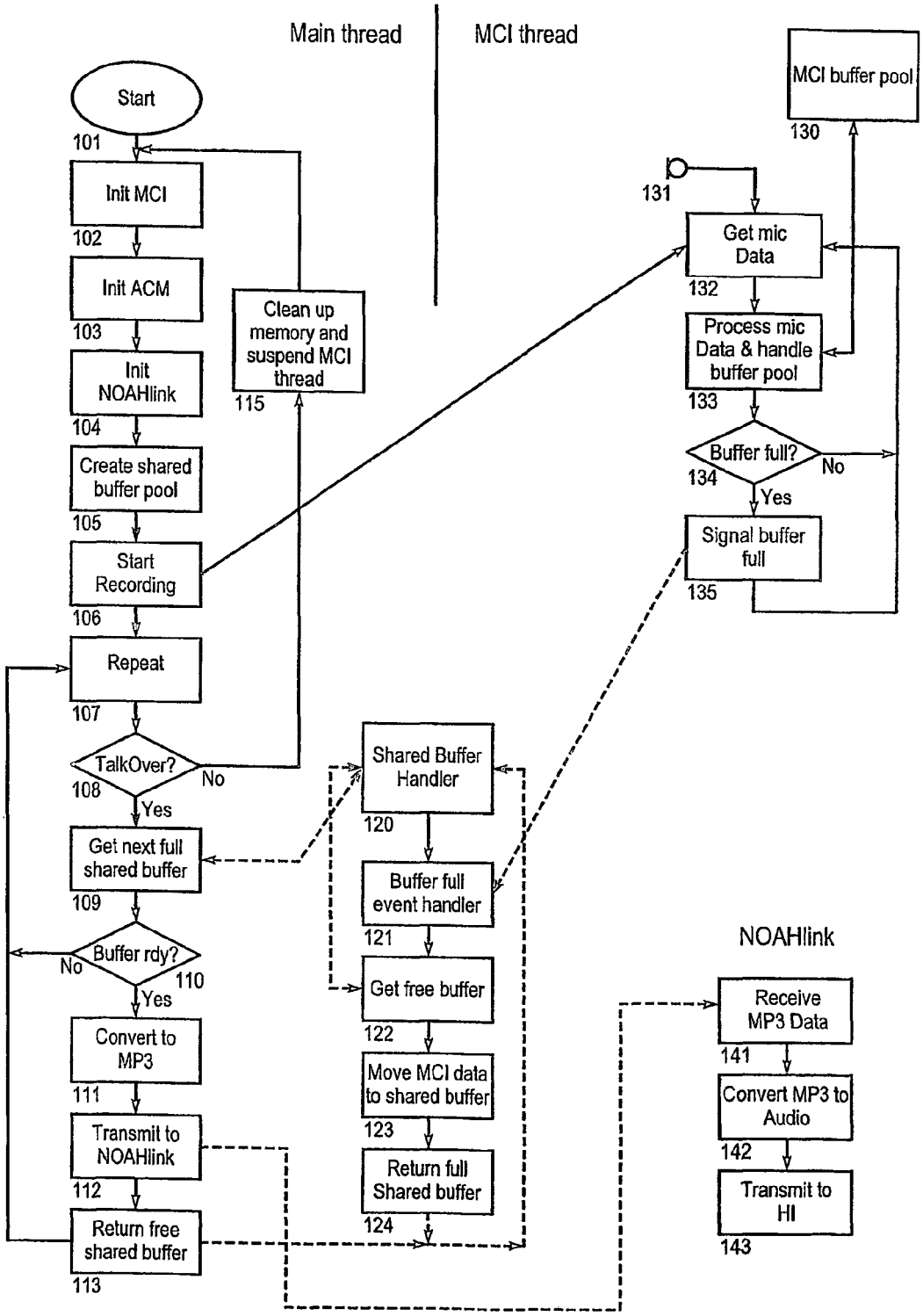
FIG. 1 is a flowchart of an algorithm for handling the talk-over functionality in real-time.

FIG. 1 shows a flowchart of the software algorithm according to the invention. The algorithm is assumed to be adapted for running on a standard computer, such as a PC, and the practical implementation of the software algorithm should be evident to a person skilled in the art. The flowchart is divided into four main parts, or threads; main, MCI, shared buffer handler, and link receiver (denoted NOAHLink in FIG. 1). The main thread is responsible for initialization of the talk-over function, the conversion, and the link transmission handler. The MCI (media control interface) thread, handles the sound data collected from the microphone and the buffers involved in this activity. The shared buffer handler forms the interface between the main thread and the MCI thread, making data packets from the MCI thread available to the main thread. The link receiver is adapted to receive compressed audio data from the main thread via the link transmission handler and to decompress the compressed audio data for reproduction by the hearing instrument.

In FIG. 1, the main thread is initialized in step 101, where an instance of the main thread is created by allocating memory for it and assigning a handle to it. In the following step 102, an instance of the media control interface, MCI, is created, whereby an MCI buffer pool 130 is created together with resources relating to the MCI's use and event handlers. In step 103, the main thread initializes the audio compression manager, ACM, object. Then, in step 104, an instance of the transmission link object is created. In step 105, an instance of the shared buffer pool (not shown) for temporary storage of the compressed audio data is created, together with a shared buffer handler 120, and the recording process in the MCI thread is initiated in step 106, as will be described in more detail in the following.

The next sequence of events are running simultaneously in concurrent threads, but for convenience they shall be described sequentially in the following. A repetition loop is set up in step 107, comprising the steps 108, 109, 110, 111, 112, and 113. In step 108, the routine determines if a talk-over flag is set to YES. This flag is controlled by a standard event handler such as a button press, or, it may be controlled by the sound level from the microphone device 131 dropping below a certain level for a predetermined length of time, e.g. turning off the talk-over function automatically when the fitter ceases speaking into the microphone. If, however, the talk-over flag is set to NO, the routine continues to step 115, where the recording is stopped, the event handlers for the link object, the ACM object, and the shared buffer pool instances are destroyed, the allocated memory is reclaimed, and the MCI thread suspended.

If the talk-over flag is set to YES, the routine continues in step 109 by collecting the next full shared buffer from the shared buffer handler 120. This buffer contains the—yet uncompressed—audio data for transmission via the transmission link. If the buffer is not yet ready, the routine continues in step 110 by repeating steps 107, 108 and 109, checking the talk-over flag again in step 108, and branching in step 110 when the buffer is ready. When the buffer is ready, a semaphore from the shared buffer handler 120 indicating this condition is received in step 109. In this case, step 110 branches the routine to step 1 11, where the buffer contents are converted to the compressed format and stored separately. In step 112, the compressed buffer contents are transferred to the transmission link. The shared buffer is then released to the shared buffer handler in step 1 13, and step 107 is executed again, collecting the next full buffer.

When the semaphore to start recording is sent to the MCI thread in step 106, the routine collects the digital representation of the analog microphone signal in step 132 from the microphone device 131 though a suitable amplifier and A/D converter (not shown). In this context, the term "recording" is the process of sampling the analog microphone signal using an A/D converter, converting the analog signal into digital data frames of equal length, and storing the frames in allocated memory by means of a suitable buffer. The signal from the microphone is processed further in step 133 and stored in the allocated MCI buffer storage space. The MCI buffer pool 130 is also handled as a separate thread in step 133, where buffer pointers and other resources relating to the MCI buffer are controlled. This control involves checking a buffer flag in step 134 indicating a full buffer, in which case the buffer needs to be emptied by the main thread, which receives the digitized microphone signals for further processing.

If the buffer is not full, the routine continues in step 132 by collecting more data from the microphone device 131 for processing in step 132. If, however, the buffer flag indicates that the buffer is full, a semaphore indicating a full buffer is sent to the buffer-full event handler 121 in the shared buffer handler routine, and the routine continues back to step 132 by collecting more microphone signals while the buffer contents is processed. The MCI thread continues operating in this way until it is suspended by step 115 in the main thread.

The shared buffer handler 120 handles the memory buffers shared by the main thread and the MCI thread. This buffer collects microphone signal data from the microphone device 131 by the MCI thread, and passes the data on for further processing by the main thread when the corresponding semaphore from the shared buffer handler 120 is received in step 109. The buffer-full event handler in step 121 receives semaphores from the MCI thread when the MCI buffer is full, as generated by step 135. In step 122, a free shared buffer is allocated from the shared buffer pool, and in step 123 the microphone signal data is moved from the MCI buffer to the shared buffer. When the shared buffer is full, the shared buffer is returned to the shared buffer handler 120 in step 124, and the shared buffer handler 120 handles the further processing of this by sending a shared buffer full semaphore to step 109 in the main thread.

The compressed audio data in step 112 are transferred to the transmission link in step 141, where the individual data frames are received for decompression in step 142. The decompression in step 142 follows the same compression scheme as the compression in step 111, but in reverse order. The compression used in the preferred embodiment is the MPEG audio layer 3-compression, which is well-known in the field of digital recording and broadcasting. Finally, the decompressed audio signal is then transmitted to the hearing instrument in step 143.

Figure 2:
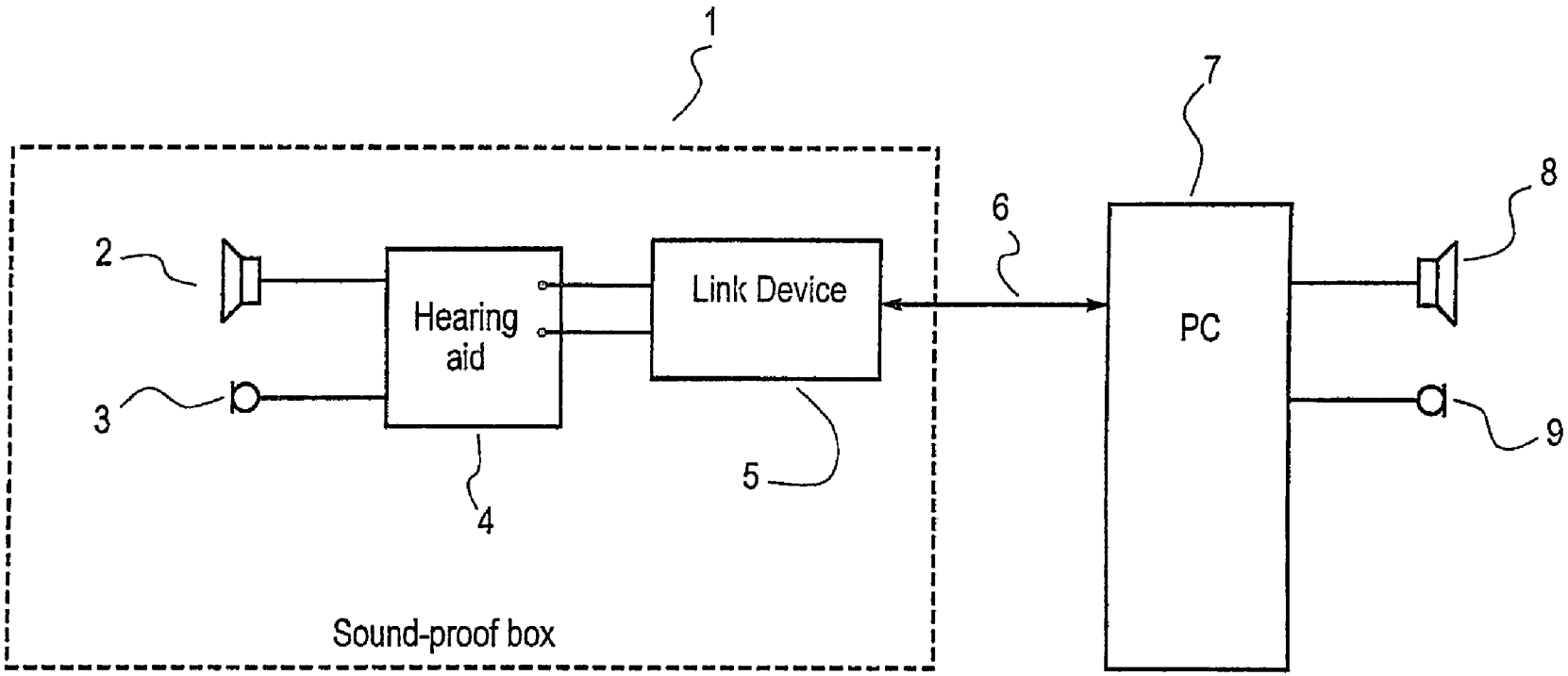
FIG. 2 is a schematic block diagram of a fitting system with a talk-over functionality.

FIG. 2 shows a setup for a fitting session with a hearing aid 4 comprising a microphone 3 and a receiver 2, i.e. a miniature speaker, symbolically placed in a sound-insulated box 1. The hearing aid 4 is connected to a link device 5, and the link device 5 is adapted for communicating with a PC 7 via a communications link 6. The communications link 6 may be a cable or a wireless connection, such as a Bluetooth® connection. The PC 7 is equipped with transmission and reception hardware, suitable audio processing hardware and audio processing software. The PC 7 is connected to a PC microphone 9 for recording sound, and, optionally, to a speaker 8 for reproducing the sound from the sound-insulated box 1, as picked up by the hearing aid microphone.

The link device 5 comprises suitable transmission and reception hardware for communicating via the communications link to the PC 7. The link device 5 is a, preferably portable, unit connected by a cable to the hearing aid 4 for the purpose of communicating with the hearing aid 4 during a programming session. The link device is further adapted for feeding into the hearing aid 4 an audio signal, which is processed in the hearing aid processor and fed to the hearing aid receiver, which produces an acoustic output signal. The cable connection between the hearing aid 4 and the link device 5 also enables the link device 5 to program the hearing aid 4 according to instructions from the PC 7. The link device 5 may also be adapted to receive an audio input from the hearing aid in order to transmit a corresponding signal via the communications link 6 to the PC.

During fitting, the hearing aid user is placed in the sound-insulated box 1, wearing the hearing aid 4. The fitting procedure is executed, involving programming the hearing aid 4 via the communications link 6 and the link device 5 to compensate the user's hearing loss by programming into the hearing aid memory suitable parameter settings, e.g. respective settings of amplifier gain in respective different frequency bands, such as high gain settings in those frequency bands where the user's auditory perception is impaired. In modern, programmable hearing aids, several different programs may be stored in memory for later selection by the user. These programs may be adapted to specific acoustic environments, or may be carefully tailored by an audiologist to fit individual user requirements and preferences. The communications link 6 connects to the PC 7, which is programmed for reading data from the hearing aid and for writing into the hearing aid memory programming parameter settings, etc.

During the fitting procedure, the audiologist gives the user of the hearing aid 4 instructions and asks questions to get user feedback during the progress of the fitting procedure. In a normal fitting scheme, this is complicated by the fact that the user of the hearing aid 4 usually has to be in the sound-insulated box 1 during fitting, with the audiologist placed outside the sound-insulated box 1.

In the set-up in FIG. 2, a direct communication channel between the audiologist and the hearing aid user is provided by the link device 5 and the communications link 6. The hearing aid 4 picks up sound from the sound-insulated box 1 by the hearing aid microphone 3, and provides an acoustical audio signal for the hearing aid receiver 2.

When the audiologist needs to make a request to the user of the hearing aid 4 or wants to ask him or her a question, he or she activates a talk-over function, either by pushing a button, by clicking an appropriate place in the graphic application user interface with a pointing device, or maybe by way of a voice activated switch, adapted to activate the talk-over function upon detecting a vocal effort of sufficient amplitude from the PC microphone 9. The sound signal from the PC microphone 9 is then converted into digital data frames in the same manner as discussed above, compressed, transmitted from the PC 7 via the communications link 6 to the link device 5, and then converted back into a sound signal. This sound signal is served by the link device 5 to the hearing aid 4, and is reproduced by the hearing aid receiver 2. In this way, a talk-over functionality may be provided in a simple and effective manner.

One practical embodiment comprises a dedicated communication device as the link device 5, such as the NOAHLink® device, manufactured by GN Otometrics A/S, Denmark and marketed by HIMSA A/S, Denmark, for connecting to a left and a right hearing aid. The NOAHLink® device comprises a Bluetooth® link for wireless communication with a PC running suitable fitting software. The software to perform the encoding/decoding of the digital audio frames may be incorporated in the firmware of the NOAHLink® device. In other embodiments, the link device 5 may be integrated partially or wholly in the hearing aid 4.

Figure 3:
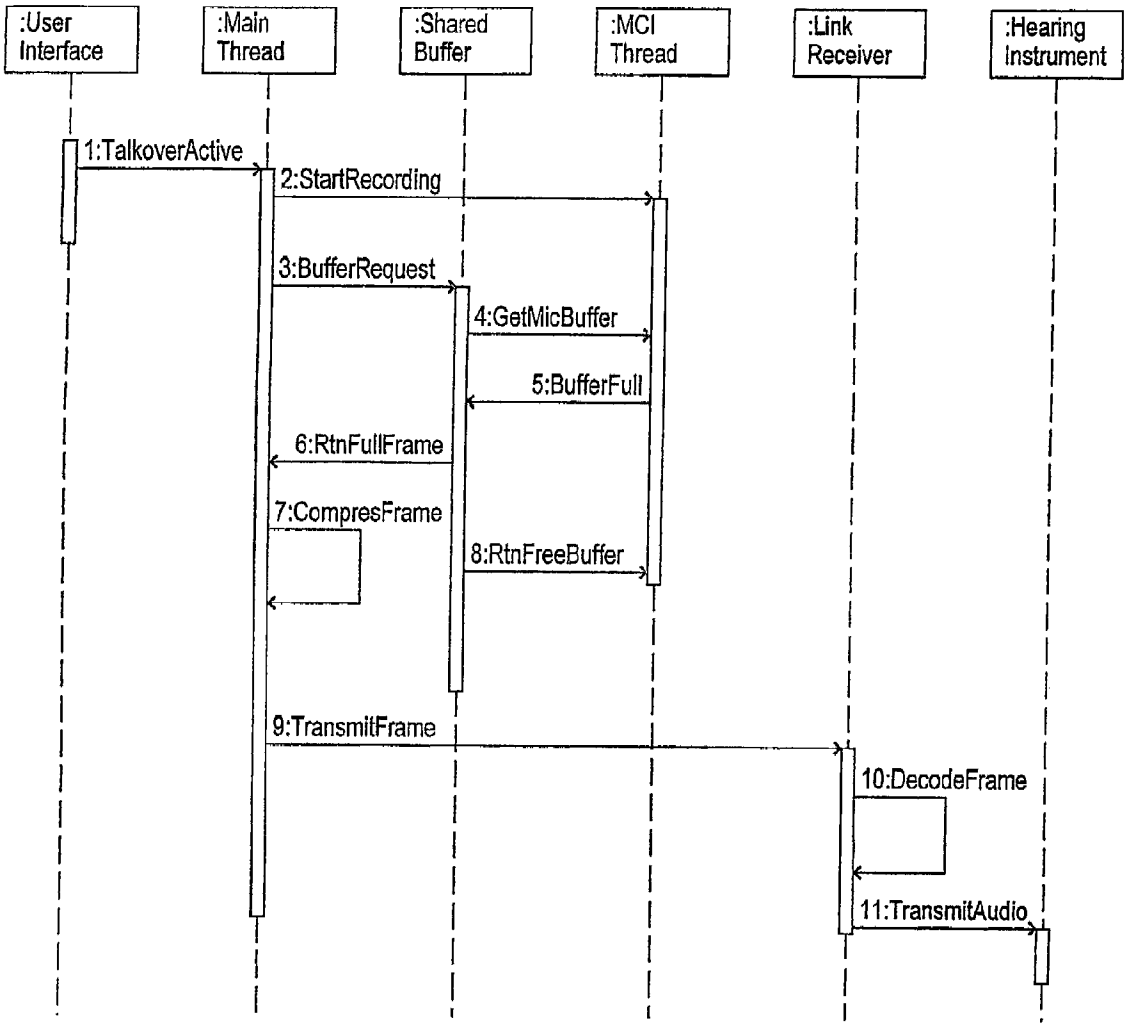
FIG. 3 is a timing diagram of the processing of audio frames during a talk-over session.

In FIG. 3 the collection, transmission, compression and decompression of single audio frames is shown in greater detail. In this sequence diagram, the six objects comprising the talk-over system are exchanging information in a predetermined way. The user-interface object represents the means for activating the talk-over function in the system, the main-thread object takes care of frame buffer requests and does the actual compression of the audio signals, the shared-buffer object handles the frame buffers, the MCI-thread object picks up the audio data from the audio hardware (microphone, amplifier and A/D converter), the link-receiver object receives and decodes the compressed audio frames, and the hearing-instrument object receives the decoded audio frames for reproduction.

The user-interface object sends a talk-over-active event to the main-thread object, thereby initiating recording. The main-thread object sends a start-recording event to the MCI-thread object, where the actual collection of audio data frames takes place. The MCI-thread object is adapted to storing these data frames in buffers allocated for this purpose for later retrieval by the MCI-thread object or by the main-thread object. The main-thread object allocates a shared buffer by sending a buffer-request semaphore to the shared-buffer object that handles the buffer activities in the application. A get-mic-buffer request semaphore is sent to the MCI-thread object to notify that the shared-buffer object is ready to receive data. The buffer in the MCI-thread collecting the microphone data is filled with audio data frames, and when this buffer is full, a buffer-full event signal is sent back to the shared-buffer object, and consequently, the physical buffer contents are transferred to the shared buffer. The shared buffer is then returned to the main-thread object for compression by sending the semaphore rtn-full-frame. Upon receiving the uncompressed audio buffer data, the main-thread object initiates the compression using a suitable compression protocol, and subsequently stores the compressed audio data frames in a separate, internal buffer (not shown).

While the main-thread object compresses the audio frame block, the shared-buffer object returns the now free shared buffer to the MCI shared buffer pool, making it available to the MCI-thread object for storage of the next audio frame block. Once the main-thread object is finished compressing the current audio frame, the compressed audio frame is transmitted to the link-receiver object using a transmit-frame message. The link-receiver object then decodes the compressed audio frame using a decompression protocol corresponding to the compression protocol used to compress the audio data frame in the main-thread object. Finally, the decoded audio data frames are transmitted to the hearing-instrument object as digital audio data, the hearing-instrument object being a system representation of the actual hearing aid used.

In this way, the different parts of the application are able to communicate talk-over audio frames recorded via a PC microphone to a hearing aid in a fast and efficient manner.

We claim:

1. A system for providing a talk-over functionality from an attendant to a hearing aid user, comprising a hearing aid, a link device connected to the hearing aid, a computer with a talk-over microphone, and a wireless communications link linking the computer to the link device, the computer having audio processing software for processing audio signals from the talk-over microphone to compress them into compressed, audio signals and for transmitting the compressed audio signals by the wireless communications link to the link device, the link device being adapted for receiving and decompressing the compressed audio signals to convert them into audio signals to be served to the hearing aid.

2. The system according to claim 1, wherein the audio processing software is adapted for converting the microphone signals into digital data packets, for compressing the digital data packets, and for generating a data stream representing the compressed, digital data packets, and wherein the wireless communications link is adapted for transmitting the data stream.

3. The system according to claim 2, wherein the link device comprises means for receiving the data stream, means for temporarily storing the received data stream, means for decompressing the data stream to form a digital audio stream, and means for transferring the digital audio stream to the hearing aid for acoustic reproduction.

4. The system according to claim 1, wherein the computer comprises means for selectively enabling the talk-over functionality.

5. The system according to claim 1, wherein the hearing aid is adapted for picking-up sound and outputting an audio signal, wherein the link device is adapted for processing the audio signal from the hearing aid, and for transmitting the processed audio signal via the wireless communications link to the computer, and wherein the computer has audio processing software for processing the signals transmitted via the wireless communications link to generate a computer-processed signal, and means for acoustically reproducing the computer-processed signals.

6. The system according to claim 1, wherein the wireless communications link is adapted for transmitting program settings to the hearing aid.

7. The system according to claim 1, wherein the wireless communications link is adapted for transmitting data from the hearing aid to the computer.

8. A system for programming a hearing aid, comprising a link device connected to the hearing aid, a computer with a talk-over microphone, and a wireless communications link linking the computer to the link device, the wireless communications link being adapted for transmitting data from the link device to the computer and from the computer to the link device, the computer being programmed for reading data from the hearing aid, for writing into the hearing aid programming parameter settings, for processing audio signals from the talk-over microphone to compress them into compressed, audio signals and for transmitting the compressed audio signals to the link device, the link device being adapted for receiving and decompressing the compressed audio signals to convert them into audio signals to be served to the hearing aid.

9. A method for providing a talk-over functionality from an attendant to a hearing aid user, comprising the steps of picking up sound signals from the attendant by a microphone, converting the picked-up sound signals into digital data frames, converting the digital data frames into compressed data frames, transmitting the compressed data frames via a wireless communications link, receiving the compressed data packets in a link device, decoding the compressed data packets in said link device, and transmitting the decoded data frames representing the sound signals to a hearing aid for acoustic reproduction.

10. The method according to claim 9, wherein the compression and decompression of the data frames utilizes a lossy algorithm based on psychoacoustic modelling.

11. The method according to claim 9, wherein the compression and decompression of the data frames utilizes a lossless compression scheme.

* * * * *